United States Patent [19]

Amitay et al.

[11] 4,413,263

[45] Nov. 1, 1983

[54] PHASED ARRAY ANTENNA EMPLOYING LINEAR SCAN FOR WIDE ANGLE ORBITAL ARC COVERAGE

[75] Inventors: Noach Amitay, Tinton Falls; Michael J. Gans, Monmouth Beach, both of N.J.

[73] Assignee: Bell Telephone Laboratories, Incorporated, Murray Hill, N.J.

[21] Appl. No.: 272,751

[22] Filed: Jun. 11, 1981

[51] Int. Cl.[3] ..... H01Q 3/36; H01Q 19/20; H01Q 15/24

[52] U.S. Cl. ..... 343/756; 343/778; 343/781 P

[58] Field of Search ..... 343/756, 778, 779, 781 P, 343/854, DIG. 2

[56] References Cited

U.S. PATENT DOCUMENTS

| | | | |
|---|---|---|---|
| 3,836,970 | 9/1974 | Reitzig | 343/100 |
| 4,203,105 | 5/1980 | Dragone et al. | 343/781 |
| 4,257,050 | 3/1981 | Ploussios | 343/854 |

OTHER PUBLICATIONS

Prickett; "High Performance Antenna Assembly"; NAECON '77 Record; Dayton Ohio; May 17–19, 1977; pp. 298–302.

Dragone & Cans; Imaging Reflector Arrangement . . . BSTJ, vol. 58, No. 2; Feb. 1979; pp. 501–515.

Poliack et al.; An Unattended Earth Terminal for Satellite Communications; COMSAT Tech., Journal, vol. 4 No. 2 Fall, 1974, pp. 205–229.

*Primary Examiner*—Eli Lieberman

*Attorney, Agent, or Firm*—Erwin W. Pfeifle

[57] ABSTRACT

The present invention relates to phased array antenna arrangements which comprise a linear array of feed elements where the array has an aperture which is out at a bias angle along the minor axis of the array to produce a fixed linear phase taper along the minor axis by all elements. Then by linearly scanning the array along the major axis of the aperture of the array, a beam is scanned along an arc which can be made to correspond to an orbital arc segment around a celestial body and within the field of view of the antenna arrangement when the bias angle is properly chosen. The feed elements can comprise long feedhorns or horn antenna configurations which can be used in a separate array or disposed in an array on a conjugate plane of a main cylindrical reflector when used in multiple reflector phased array antenna arrangements.

7 Claims, 7 Drawing Figures

PHASED ARRAY ANTENNA EMPLOYING LINEAR SCAN FOR WIDE ANGLE ORBITAL ARC COVERAGE

BACKGROUND OF THE INVENTION

1. Field of the Invention

The present invention relates to phased array antenna systems which are arranged to scan over a wide angle of an orbital arc segment from a terrestrial ground station to access or track satellites within the arc segment and, more particularly, to phased array antenna systems which provide wide angle linear scan capability by orienting the phased array antenna system in a predetermined manner relative to the local terrestrial coordinate system and then squinting the beam towards the orbital arc segment.

2. Description of the Prior Art

With high capacity satellite communication systems as with subscription program satellite systems vendors or users, ground stations may wish to communicate with two or more satellites positioned at different locations along the Geosynchronous Equatorial Arc (GEA). At present, a separate ground station antenna would be used to communicate with each satellite of the system making ground stations more complex and costly. A single antenna that can track or simultaneously or sequentially communicate with all satellites of interest could circumvent the above problems.

Movable antennas of the type disclosed in, for example, U.S. Pat. Nos. 3,836,969 issued to D. S. Bond et al on Sept. 17, 1974 and 3,945,015 issued to M. Gueguen on Mar. 16, 1976 could be used for tracking purposes or for communicating with one or more satellites, but such type antennas are not useful when fast switching between multiple satellites is required. Multibeam reflector antennas using separate feedhorns as disclosed, for example, U.S. Pat. Nos. 3,914,768 issued to E. A. Ohm on Oct. 21, 1975 and 4,145,695 issued to M. J. Gans on Mar. 20, 1979 or using phased arrays as disclosed, for example, in U.S. Pat. Nos. 3,340,531 issued to G. P. Kefalas et al on Sept. 5, 1967 and 3,806,930 issued to J. F. Gobert on Apr. 23, 1974 have also been suggested for satellite ground stations. In some of such type antennas, oversized reflectors may be required while the scanning capability of others may be limited by excessive gain loss. With some of the specially designed and aberration correcting multireflector antennas with multiple feeds, for example, for a 0.5 degree beamwidth and 45 degrees of GEA coverage, a ±45 beamwidth scan capability is required. Such severe requirement introduces an antenna gain loss of 1 dB or more due to phase aberrations, as well as imposing a cumbersome antenna structure.

The problem, therefore, remaining in the prior art is to provide an antenna having wide angle scan capabilities which circumvents the gain loss experienced by prior art antennas while simplifying the antenna structure.

SUMMARY OF THE INVENTION

The foregoing problems have been solved in accordance with the present invention which relates to phased array antenna systems which are arranged to scan over a wide angle of an orbital arc segment from a terrestrial ground station to access or track satellites within the arc segment and, more particularly, to phased array antenna systems which provide wide angle linear scan capabilities by orienting the phased array antenna system in a predetermined manner relative to the local terrestrial coordinate system and then squinting the beam towards the orbital arc segment.

It is an aspect of the present invention to provide a linear phased array antenna system which has wide angle scan capability of an orbital arc segment about a celestial body once the array is oriented such that the orbital arc segment lies in a plane substantially parallel to a cardinal plane in a directional cosine coordinate system of the array. The linear phased array is arranged to transmit or receive a beam which is squinted or offset by a fixed predetermined amount to direct the beam at the orbital arc segment and produce a minimum beam pointing error when scanning the beam over the orbital arc segment after which the linear phase taper across the array can be varied to direct the beam to any point on the orbital arc segment.

It is a further aspect of the present invention to provide an antenna system comprising an offset cylindrical main reflector, a cylindrical subreflector disposed confocally and coaxially with the main reflector and a linear phased array disposed on an image plane of the main reflector which is capable of providing a wide angle scan of an orbital arc segment around a celestial body using a squinted beam. More particularly, the antenna system is oriented such that the orbital arc segment lies in a plane substantially parallel to a specific cardinal plane in a directional cosine coordinate system of the antenna system. This cardinal plane is defined by the common focal line and common axis of the cylindrical reflectors. In a preferred embodiment of the present antenna system, a ray from the antenna system which is directed at the center of the field of view of the antenna system is (a) launched by the linear phased array at an angle perpendicular to the major axis along the linearly aligned elements of the array and at a predetermined angle to the plane of the free space interface of the array in a direction orthogonal to the major axis of the array to produce the necessary squinted beam, (b) directed at approximately the center of the orbital arc segment, and (c) directed by the antenna system parallel to the axis of the antenna system.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

The present invention is described hereinafter as an antenna arrangement for the wide angle linear scanning of a segment of the Geosynchronous Equatorial Arc (GEA) using a linear phased array antenna comprising properly phased elements. It is to be understood that such description is merely for purposes of exposition and not for purposes of limitation since the present technique could similarly be used for linearly scanning, tracking, or simultaneously or sequentially communicating with one or more satellites disposed in any orbital arc segment once the antenna has been properly oriented in relation to the orbital arc segment of interest. Additionally any linear scanning antenna which can be squinted as described hereinafter towards the orbital arc segment of interest can be used for the linear phased array antenna described.

A technique for enabling an antenna system to linearly scan over a wide angle of an orbital arc segment from a terrestrial ground station to access or track satellites within the segment is disclosed in a copending patent application Ser. No. 272,750 filed for N. Amitay on the same day as the present application and assigned to the same assignee as the present application. As described in the copending application, the wide angle linear scan capability is achieved by orienting the antenna system at the ground station relative to the local terrestrial coordinate system such that the axis normal to the aperture plane of the antenna system is at a predetermined angle and lies in a plane substantially parallel to the plane of the orbital arc segment. Then, by fixedly squinting the beam toward the orbital arc segment, linear scanning of the orbital arc segment is achieved by varying the linear phase taper applied to antenna elements of the array along the axis of scan.

Figure 1:
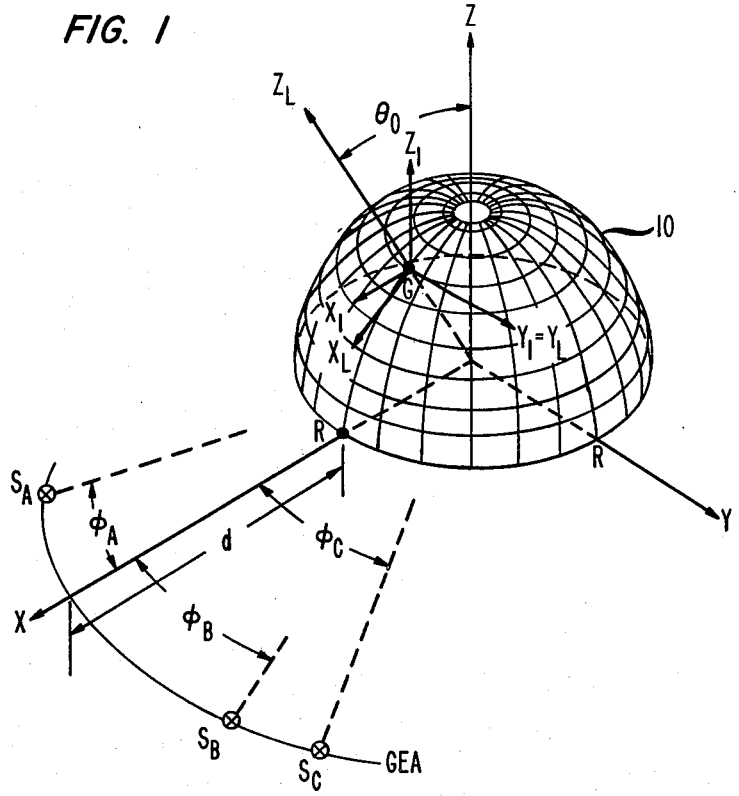
FIG. 1 illustrates the hemisphere of a celestial body including a ground station and three satellites in a Geosynchronous Equatorial Arc (GEA) segment and a terrestrial surface and a local coordinate system at the ground station location.

To provide a clear understanding of the proper orientation of a linear phased array to permit the linear scanning of an orbital arc segment of interest, the technique disclosed in the copending application of N. Amitay will be briefly described hereinafter in association with FIG. 1. FIG. 1 shows a hemisphere of a celestial body 10 having a radius R which is divided at its equator. A ground station G associated with a communication system is disposed on the surface of celestial body 10 at a predetermined latitude and longitude. The celestial body polar coordinates are represented by a polar axis Z, an X axis which intersects the meridian of the ground station G and a Y axis. Three satellites $S_A$, $S_B$ and $S_C$ associated with the communication system are depicted in orbit on a segment of the GEA about celestial body 10 at a distance d from the equator and at the azimuth angles $\phi_A$, $\phi_B$ and $\phi_C$, respectively, from the celestial coordinate axis X within the view of ground station G.

Figure 3:
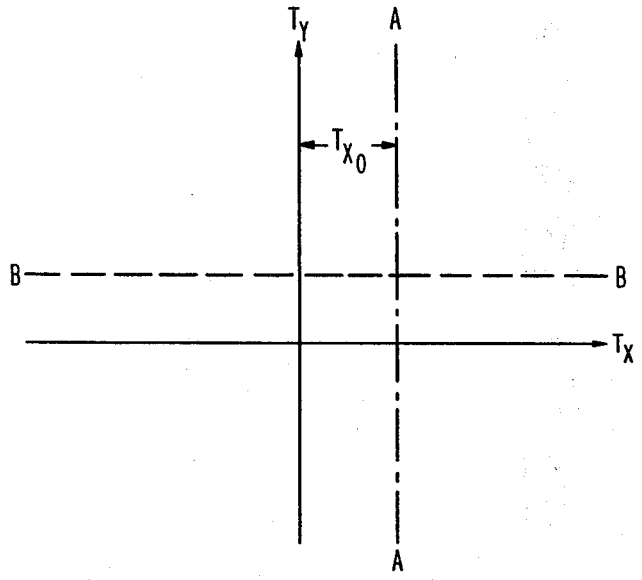
FIG. 3 illustrates a directional cosine coordinate system of an array of antenna elements.

To communicate with the satellites $S_A$, $S_B$ and $S_C$, independent beam forming systems (one per satellite) at the ground station will combine (split) and transmit (receive) the appropriate signals, after proper amplification, via a single array antenna. A linear scan can be utilized for a multisatellite system when the satellite locations lie in either the cardinal plane of the array directional cosine coordinate system or in a plane substantially parallel to a cardinal plane of the array directional cosine coordinate system as shown in FIG. 3. The directional cosine coordinate system of an antenna can be derived using well known mathemetical principles. The orientation of the satellites in a plane substantially parallel to a cardinal plane is preferable since the beam of the antenna can be scanned to track the GEA arc segment and all satellites located in that segment and no antenna reorientation is necessary if a satellite is moved or replaced by another satellite in another location on the arc segment and only a modification of the beam forming system is necessary.

Also shown in FIG. 1 is a terrestrial surface coordinate system designated by the axes $X_1$, $Y_1$ and $Z_1$ at the ground station and a local coordinate system designated by the axes $X_L$, $Y_L$ and $Z_L$ also at ground station G. The terrestrial surface coordinate system is derived by a translation of the celestial body polar coordinate system comprising the X, Y and Z axes to the location of ground station G on the surface of celestial body 10. The local coordinate system at ground station G is derived by rotating the $X_1$, $Y_1$ and $Z_1$ axes of the terrestrial surface coordinate system about the $Y_1$ axis until the $Z_1$ axis is aligned with the line interconnecting the center of the celestial body polar coordinate system and the ground station.

Figure 2:
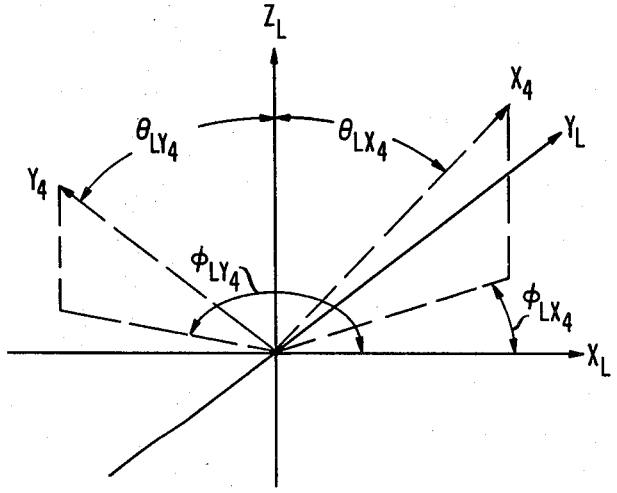
FIG. 2 illustrates the relationship between the local coordinate system of FIG. 1 and a final coordinate system after predetermined rotations of the terrestrial surface coordinate system of FIG. 1.

In accordance with the copending application of N. Amitay, the plane of the array is properly oriented by sequential rotations of (1) the terrestrial surface coordinate systems around the $Z_1$ axis by an angle $\phi_x$ to produce a second intermediate terrestrial surface coordinate system comprising a first, second and third axis ($X_2$, $Y_2$, $Z_2$) which directs the first axis thereof to transit near the center of the orbital arc segment, (2) the second intermediate terrestrial surface coordinate system around its second axis, $Y_2$, by an angle $$-\left(\frac{\pi}{2}+\beta\right)$$

to produce a third intermediate terrestrial surface coordinate system comprising a first, second and third axis ($X_3$, $Y_3$, $Z_3$) which directs the third axis, $Z_3$, thereof at a predetermined angle and substantially parallel to the plane of the orbital arc segment, and (3) the third intermediate terrestrial surface coordinate system around its third axis, $Z_3$, by an angle $\nu$ to produce a fourth intermediate terrestrial surface coordinate system comprising a first, second and third axis ($X_4$, $Y_4$, $Z_4$), such that an array disposed in the plane of the first and second axes of the fourth intermediate terrestrial surface coordinate system is related to the local coordinate system as shown in FIG. 2 by the relationship:

$$\phi_{LX4} = \tan^{-1}\frac{Y_L(X_4)}{X_L(X_4)},\ \phi_{LY4} = \tan^{-1}\frac{Y_L(Y_4)}{X_L(Y_4)}, \tag{1}$$

$$\theta_{LX4} = \tan^{-1}\frac{\sqrt{X_L^2(X_4)+Y_L^2(X_4)}}{Z_L(X_4)} \text{ and}$$

$$\theta_{LY4} = \tan^{-1}\frac{\sqrt{X_L^2(Y_4)+Y_L^2(Y_4)}}{Z_L(Y_4)}$$

where $\phi_{LX4}$ and $\phi_{LY4}$ are the azimuth angles of the projections of the first and second axes, respectively, of the planar aperture relative to the first axis of the local coordinate system, $\phi_{LX4}$ and $\phi_{LY4}$ are the angles of the first and second axes, respectively, of the planar aperture relative to the third axis ($Z_L$) of the local coordinate system, and the local coordinate system axes $X_L$, $Y_L$ and $Z_L$ as a function of the $X_4$ and $Y_4$ axes of the fourth intermediate terrestrial surface coordinate system can be defined by:

$$
\begin{aligned}
X_L(X_4) &= X_4\{-[\cos\mu\sin\beta\cos\phi_X + \sin\mu\sin\phi_X]\cos\theta_0 + \cos\mu\cos\beta\sin\theta_0\}, \quad (2)\\
Y_L(X_4) &= X_4\{-\cos\mu\sin\beta\sin\phi_X + \sin\mu\cos\phi_X\},\\
Z_L(X_4) &= -X_4\{[\cos\mu\sin\beta\cos\phi_X + \sin\mu\sin\phi_X]\sin\theta_0 + \cos\mu\cos\beta\cos\theta_0\},\\
X_L(Y_4) &= Y_4\{[\sin\mu\sin\beta\cos\phi_X - \cos\mu\sin\phi_X]\cos\theta_0 - \sin\mu\cos\beta\sin\theta_0\},\\
Y_L(Y_4) &= Y_4\{\sin\mu\sin\beta\sin\phi_X + \cos\mu\cos\phi_X\},\\
Z_L(Y_4) &= Y_4\{[\sin\mu\sin\beta\cos\phi_X - \cos\mu\sin\phi_X]\sin\theta_0 + \sin\mu\cos\beta\cos\theta_0\}.
\end{aligned}
$$

Figure 4:
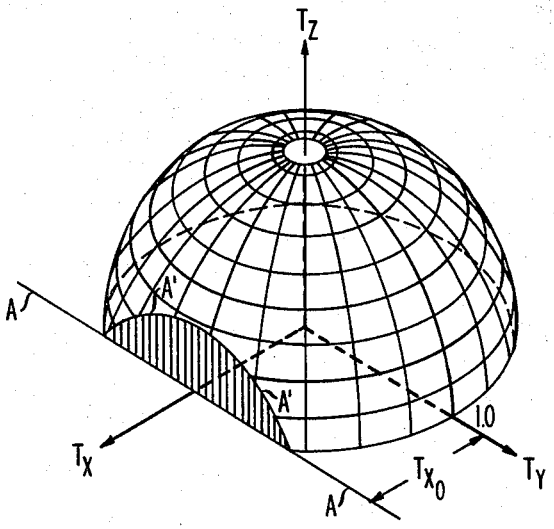
FIG. 4 illustrates a $T_x$=constant surface for a unit hemisphere in the directional cosine coordinate system of FIG. 3.

With the array oriented as outlined above, one dimensional or linear scanning with a fixedly squinted beam can be used when the desired segment of the GEA lies very close to a plane parallel to a cardinal plane in the $T_x$-$T_y$ coordinates of the array as represented by either one of planes A—A or B—B in FIG. 3. If a unit radius hemisphere were placed on the directional cosine coordinate system of FIG. 3, it should be emphasized that a $T_x$=constant plane in the $T_x$-$T_y$ coordinates, A—A, corresponds to an arc A'—A' on the hemisphere as shown in FIG. 4. As the maximum of an appropriately squinted antenna beam is linearly scanned along A—A in FIG. 3, the corresponding beam maximum will move along the circular arc A'—A' in FIG. 4 which, in turn, tracks the GEA segment of interest.

Figure 5:
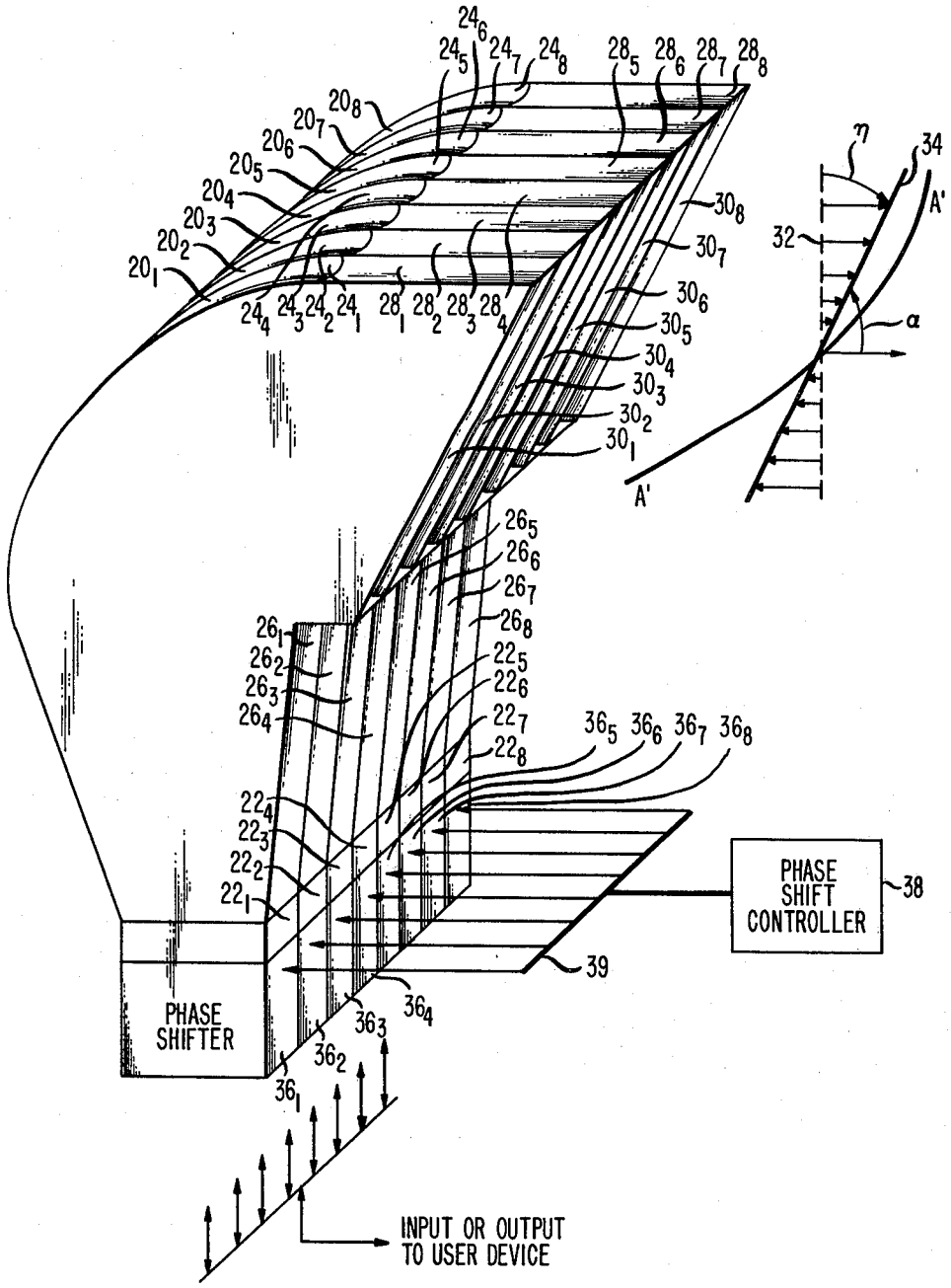
FIG. 5 is a view in isometric of a linear phased array antenna arrangement in accordance with the present invention.

A linear phased array antenna arrangement in accordance with the present invention is shown in FIG. 5, which arrangement is capable of launching a beam of electromagnetic energy that has a fixed linear phase taper along a first axis of the aperture of the array such that when the beam is linearly scanned along a second axis of the aperture orthogonal to the first axis, the beam will move along the arc A'—A' of FIG. 4. In FIG. 5, a linear array of eight miniature horn antennas $\mathbf{20_1}$–$\mathbf{20_8}$ are shown where each horn antenna 20 comprises an entrance waveguide section $\mathbf{22_1}$–$\mathbf{22_8}$, a parabolic reflector $\mathbf{24_1}$–$\mathbf{24_8}$, a waveguide section $\mathbf{26_1}$–$\mathbf{26_8}$ which extends the entrance waveguide section 22 to the reflector 26 and is tapered when viewing the side of the horn but uniform in width from the front of each horn, and an extension $\mathbf{28_1}$–$\mathbf{28_8}$ which produces a bias cut aperture $\mathbf{30_1}$–$\mathbf{30_8}$ which lies in a plane across the front of the array.

Prior art linear arrays have generally produced wavefronts which have a fixed phase progression across the aperture as indicated by dashed line 32 which would be produced if there were no bias cut on extensions $\mathbf{28_1}$–$\mathbf{28_8}$. Such fixed phase progression would produce a line scan across the field of view as the array scanned from side to side. However, in accordance with the present invention, the bias cut of the array at the aperture as shown in FIG. 5 produces a fixed linear phase taper shown by line 34, in the wavefront at the aperture in the top to bottom direction of the array. With such fixed linear phase taper along one axis of the aperture, when the beam produced by the array is scanned in the orthogonal axis, the beam will move along an arc segment A'—A' which will track an orbital arc segment when the appropriate bias angle of the cut is used at the aperture.

Coupled to the entrance waveguide sections $\mathbf{22_1}$–$\mathbf{22_8}$ are phase shifters $\mathbf{36_1}$–$\mathbf{36_8}$, respectively, which are responsive to control signals from a phase shift controller 38 over separate leads in a bus 39 to introduce a separate predetermined phase shift into the signal propagating through each phase shifter $\mathbf{36_1}$–$\mathbf{36_8}$. Each of the concurrent instantaneous separate phase shift control signals to phase shifters $\mathbf{36_1}$–$\mathbf{36_8}$ are arranged to cause phase shifters $\mathbf{36_1}$–$\mathbf{36_8}$ to produce an instantaneous predetermined linear phase taper across the aperture in a direction orthogonal to the bias cut to direct the beam at a certain predetermined point on arc A'—A'. By changing the linear phase taper produced by phase shifters $\mathbf{36_1}$–$\mathbf{36_8}$, it is possible to direct the beam to any point along arc A'—A' which, in turn, corresponds to the orbital arc segment. It is to be understood that phase shift controller 38 can comprise a microprocessor and associated memory for storing the necessary control signals to produce the linear phase taper necessary to access each satellite of interest on the orbital arc segment. The microprocessor can then produce a desired scan sequence or be accessed locally for producing a specific linear phase taper for a desired length of time for accessing a particular satellite. Controller 38 can also comprise an arrangement as shown in U.S. Pat. No. 3,978,482 issued to F. C. Williams et al on Aug. 31, 1976.

Figure 6:
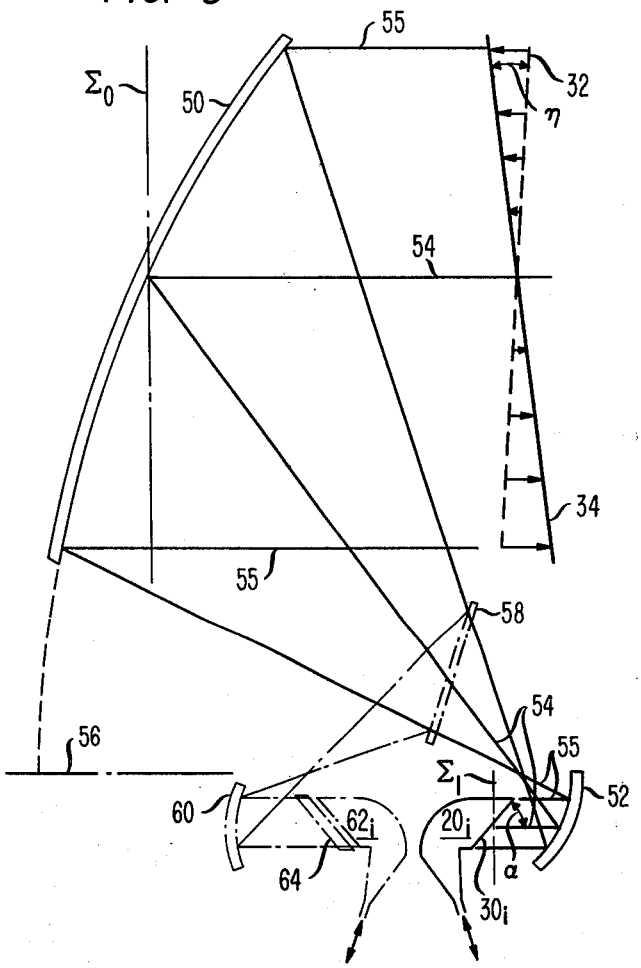
FIG. 6 is a view in cross-section of a two reflector linear phased array antenna arrangement with the feed array of FIG. 5 and an optical arrangement for dual polarization use.

FIG. 6 illustrates how the phased array antenna arrangement of FIG. 5 could be applied in a dual-reflector antenna arrangement if so desired. Certain of the concepts disclosed in U.S. Pat. No. 4,203,105 issued to C. Dragone et al on May 13, 1980 along with certain concepts described hereinbefore are used in the arrangement of FIG. 6 to produce a scanable antenna arrangement capable of producing a large image of a small array with minimal aberrations. In FIG. 6 the antenna arrangement comprises a cylindrical main reflector 50 and a cylindrical subreflector 52 disposed confocally and coaxially with each other and a phased array $\mathbf{20}_i$ of miniature horns as shown in FIG. 5, which feed array is disposed on a plane $\Sigma_1$ such that the center of the plane intersects the center of the bias cut and plane $\Sigma_1$ is a conjugate plane relative to the aperture plane $\Sigma_0$ at main reflector 50. Additionally, it is preferred that the antenna arrangement is oriented so that a central ray 54 of a beam 55 launched by the array of horns 20 which is directed to the center of the field of view of the antenna is also directed at the center of the orbital arc segment of interest and parallel to the axis 56 of main reflector 50.

Where dual polarization capability is desired, a polarization diplexer 58 can be inserted in the beam area between main reflector 50 and subreflector 52. Diplexer 58 can comprise any suitable device such as, for example, the well known parallel wire grid which passes wavefronts in a first direction of polarization parallel to the wires of the grid and reflects wavefronts in a second direction of polarization orthogonal to the wires of the grid. The reflected wavefronts are reflected by a cylindrical subreflector 60 toward a second linear array of miniature horns $\mathbf{62}_i$ similar to the array $\mathbf{20}_i$ which corresponds to the array of FIG. 5.

Array $\mathbf{62}_i$ has a similar bias cut aperture as found with array $\mathbf{20}_i$ and must linearly scan in the same direction as array $\mathbf{20}i$ to enable array $\mathbf{62}i$ to access all the satellites on the orbital arc segment of interest. Therefore, array $\mathbf{62}_i$ cannot be disposed with the major axis of the aperture orthogonal to the major axis of the aperture of array 20 to properly intercept the orthogonally polarized signals because under such condition the array could not track the orbital arc segment. A polarization rotation means 64 is inserted between subreflector 60 and array $62_i$ to rotate the direction of polarization by 90 degrees and properly align the signal for reception by array $62_i$. Polarization rotation means 64 can comprise any suitable arrangement as, for example, a series of differently inclined wire gratings as disclosed in FIG. 4 of U.S. Pat. No. 2,554,936 issued to R. L. Burtner on May 29, 1950 or FIG. 5 of the article "Microwave Transmission Through a Series of Inclined Gratings" by Hill et al in *Proceedings of the IEE*, Vol. 120, No. 4, April 1973, at pp. 407-412, or a twist reflector forming part of subreflector 60 as disclosed, for example, in U.S. Pat. No. 3,771,160 issued to E. Laverick on Nov. 6, 1973.

Figure 7:
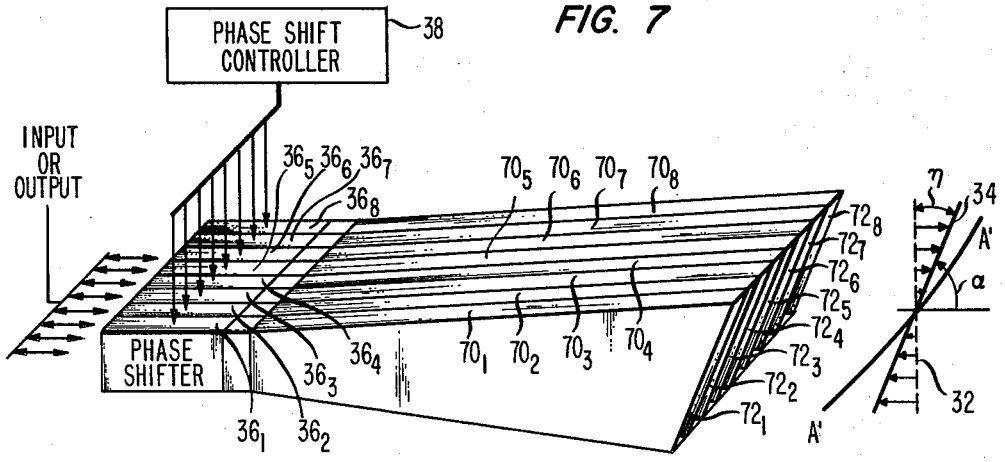
FIG. 7 is a view in isometric of a linear phased array antenna arrangement comprising a linear array of bias cut horns as an alternative arrangement to the arrangement of FIG. 5.

An alternative arrangement to the array of FIG. 5 is shown in FIG. 7. In FIG. 7 the array comprises a plurality of 8 long feedhorns $70_1$-$70_8$ having a bias cut aperture $72_1$-$72_8$ which produces a fixed linear phase taper 34 along the major axis of each feedhorn 70. As with the array of FIG. 5, the array of FIG. 7 when scanned along the major axis of the overall array, orthogonal to the bias cut, by varying the phase to each feedhorn by phase shifters $36_1$-$36_8$ under the control of phase shift controller 38, the beam will track arc A'—A'.

If an array similar to FIGS. 5 and 7 are used by themselves without reflectors, the relationship of the tilt or the bias cut angle, $\alpha$, to the amount of squint, $\eta$, required is determined from $$\alpha = 90 \text{ degrees } - \eta. \tag{3}$$

For the arrangement of FIG. 6, where reflectors are used the tilt or bias cut angle, $\alpha$, can be determined from $$\alpha = \arctan \frac{1 - \sqrt{\cos^2\mu - (M\sin\eta)^2 (\cos\eta - \sqrt{\cos^2\mu - \sin^2\eta})^2}}{M\sin\eta(\cos\eta - \sqrt{\cos^2\mu - \sin^2\eta})} \tag{4}$$

where M is the magnification of the reflector system and where $\mu$ is one-half the scan angle across the orbital arc segment of interest. It is to be understood that for a preferred operation of the feedhorns of FIG. 7, each horn 70 should have a length along its longitudinal axis such that the phase error at the aperture should be equal to or less than $\lambda/8$, where $\lambda$ is the frequency of the signal being launched or received.

It is to be understood that the above-described embodiments are simply illustrative of the principles of the invention. Various other modifications and changes may be made by those skilled in the art which will embody the principles of the invention and fall within the spirit and scope thereof. For example, phase shifters 36 in FIGS. 5 and 7 could be replaced with the well known Rotman lens to provide the necessary linear phase taper across the array by placing the signal sources for each satellite at the appropriate location with respect to such lens to produce the proper linear phase taper.

What is claimed is:

1. A phased array antenna arrangement comprising:

a plurality of feed elements (20, 62, 70) arranged in a linear array and capable of launching or receiving a planar wavefront at an aperture of the array; and phase shifting means (36) for selectively producing a predetermined linear plane taper along a first axis across the aperture of the array characterized in that the aperture of the linear array formed from the plurality of feed elements is cut at a predetermined bias angle ($\alpha$) to a ray directed from the center of the aperture to the center of the field of view of the antenna arrangement to produce a fixed linear phase taper along a second axis of the aperture of the array orthogonal to the first axis thereof to produce a predetermined squinted beam, the predetermined bias angle producing a beam which traverses a predetermined arc (A'—A') when linearly scanned along the first axis.

2. A phased array antenna arrangement according to claim 1 characterized in that each of the plurality of feed elements comprises a feedhorn (70) including a length along a longitudinal axis thereof such that a phase error at the aperture is equal to or less than $\lambda/8$, where $\lambda$ is the frequency of a signal being launched or received by the antenna arrangement.

3. A phased array antenna arrangement according to claim 1 characterized in that each of the plurality of feed elements comprises a horn antenna arrangement ($20_1$-$20_8$) including: an entrance port ($22_1$-$22_8$); an offset parabolic reflector ($24_1$-$24_8$); a waveguide section ($26_1$-$26_8$) which connects the entrance port to the offset parabolic reflector, tapers outward from the entrance port on at least two opposing sides thereof, and has an opening opposite the offset parabolic reflector along a feed axis from the entrance port of the antenna arrangement; and a waveguide extension ($28_1$-$28_8$) which extends outward from the opening of the waveguide section and includes the bias angle cut forming the aperture of the antenna arrangement.

4. A phased array antenna arrangement according to claim 2 or 3 characterized in that the predetermined bias angle of the cut at the aperture of the array can be determined from the expression $\alpha = 90$ degrees $-\eta$, where $\alpha$ is the bias angle of the cut at the aperture relative to the ray directed from the center of the aperture to the center of the field of view of the antenna arrangement to produce the beam which traverses the predetermined arc when linearly scanned across the first axis, and $\eta$ is the angle of the fixed linear phase taper produced by the bias cut relative to a plane orthogonal to said center ray.

5. A phased array antenna arrangement according to claim 1, 2 or 3 characterized in that the antenna arrangement further comprises:

a cylindrical offset main reflector (50) comprising a predetermined aperture; and a cylindrical subreflector (52) disposed confocally and coaxially with said offset main reflector with the linear axis across the reflecting surface of each of said cylindrical main reflector and cylindrical subreflector being aligned parallel to each other; and the plurality of feed elements forming the linear array are disposed such that the aperture of the array is disposed at a plane ($\Sigma_1$) which is a conjugate plane relative to the aperture plane ($\Sigma_0$) of the main reflector and the second axis of the aperture of the array is aligned parallel to said linear axes of the cylindrical main reflector and cylindrical subreflector.

6. A phased array antenna arrangement according to claim 5 characterized in that the predetermined bias angle of the cut at the aperture of the array can be determined from $$\alpha = \arctan \frac{1 - \sqrt{\cos^2\mu - (M\sin\eta)^2 (\cos\eta - \sqrt{\cos^2\mu - \sin^2\eta})^2}}{M\sin\eta(\cos\eta - \sqrt{\cos^2\mu - \sin^2\eta})}$$

where $\alpha$ is the bias angle of the cut at the aperture relative to the ray directed from the center of the aperture of the linear array to the center of the field of view of the antenna arrangement, $\eta$ is the angle of the fixed linear phase taper produced by the bias cut relative to a plane orthogonal to said center ray at the aperture of the main reflector, and $\mu$ is one-half of the overall angle of scan required.

7. A phased array antenna arrangement according to claim 5 characterized in that the antenna arrangement further comprises:

a polarization diplexing means (58) disposed between the offset main reflector and the subreflector for passing wavefronts polarized in a first polarization direction toward the cylindrical subreflector and for reflecting wavefronts polarized in a second polarization direction orthogonal to said first polarization direction;

a second cylindrical subreflector (60) disposed (a) with the linear axis of the reflecting surface arranged parallel to the linear axis of the cylindrical main reflector, (b) confocally and coaxially with the cylindrical main reflector, and (c) for reflecting the wavefronts reflected by said polarization diplexing means to a second conjugate plane relative to the aperture plane ($\Sigma_0$) of the main reflector;

a second plurality of feed elements (62) arranged in a second linear array which is disposed on the second conjugate plane relative to the aperture plane of the main reflector, the second linear array comprising an aperture having both a first axis across the feed elements of the array which is disposed parallel to the linear axis of the second subreflector and a second axis orthogonal to the first axis along which the aperture is cut at a predetermined bias angle to a ray directed from the center of the second array which is reflected by the main reflector to the center of the field of view of the antenna arrangement to produce a fixed linear phase taper along the second axis of the second linear array;

phase shifting means for selectively producing a predetermined linear phase taper along the first axis across the aperture of the array; and polarization rotating means (64) disposed between the polarization diplexing means and the second linear array along the path of said center ray for rotating the second polarization direction by 90 degrees.

* * * * *